US008882617B2

(12) United States Patent
Kume et al.

(10) Patent No.: US 8,882,617 B2
(45) Date of Patent: Nov. 11, 2014

(54) BASEBALL

(75) Inventors: Kazuhiro Kume, Osaka (JP); Takashi Ono, Osaka (JP); Yohei Yamashita, Osaka (JP)

(73) Assignee: Mizuno Corporation, Osaka (JP)

( * ) Notice: Subject to any disclaimer, the term of this patent is extended or adjusted under 35 U.S.C. 154(b) by 146 days.

(21) Appl. No.: 13/198,205

(22) Filed: Aug. 4, 2011

(65) Prior Publication Data

US 2012/0035008 A1 Feb. 9, 2012

(30) Foreign Application Priority Data

Aug. 5, 2010 (JP) ..... 2010-176297

(51) Int. Cl.
*A63B 37/02* (2006.01)

(52) U.S. Cl.
USPC ..... 473/600; 473/601

(58) Field of Classification Search
USPC ..... 473/600, 601, 602
See application file for complete search history.

(56) References Cited

U.S. PATENT DOCUMENTS 2,278,649 A * 4/1942 Dickson et al. ..... 473/602
4,660,830 A * 4/1987 Tomar ..... 473/601
5,647,590 A * 7/1997 Walker et al. ..... 473/601
5,951,420 A * 9/1999 Talarico et al. ..... 473/601
6,369,125 B1 * 4/2002 Nesbitt ..... 522/142
6,653,363 B1 * 11/2003 Tursi et al. ..... 521/174
2004/0102265 A1 * 5/2004 Laliberty et al. ..... 473/601

FOREIGN PATENT DOCUMENTS

JP S6088566 5/1985
JP 2002-210043 7/2002

OTHER PUBLICATIONS

Office Action from Japanese Patent Office dated Nov. 12, 2013 for co-pending Japanese Application No. 2010-176297.

* cited by examiner

*Primary Examiner* — Vishu K. Mendiratta
(74) *Attorney, Agent, or Firm* — Troutman Sanders, LLP; James E. Schutz; Daniel Sharpe

(57) ABSTRACT

There is provided a baseball including an inner core, and an outer core covering an outer circumferential surface of the inner core, the inner core being formed to have a dimension of 20% or more and 80% or less of an outer diameter of the inner core and the outer core of the baseball, and having a dynamic viscoelasticity loss coefficient (tan δ) of 0.3 or less, the outer core being formed to have a thickness of 10% or more and 40% or less of the outer diameter of the inner core and the outer core of the baseball, and having an elastic modulus of 1.5 MPa or less. As a result, there can be obtained a baseball that achieves a high level of safety when the baseball hits against a human body and achieves a hit distance equal to and longer than that of a ball for hardball.

7 Claims, 12 Drawing Sheets

BASEBALL

This nonprovisional application is based on Japanese Patent Application No. 2010-176297 filed on Aug. 5, 2010 with the Japan Patent Office, the entire contents of which are hereby incorporated by reference.

BACKGROUND OF THE INVENTION

1. Field of the Invention

The present invention relates to a baseball, and particularly to a solid baseball.

2. Description of the Background Art

As for a baseball, it is desired to improve safety by decreasing the impact force when the baseball hits against a human body. For example, in Little League, the hardness and the restitution coefficient of a ball for hardball are defined to improve safety when younger children play baseball. According to the rules of Little League, the hardness of the baseball is defined such that a load when the baseball is compressed by 6.35 mm is less than 45 lbf (200.17 N). In addition, the restitution coefficient of the baseball when the baseball hits against an iron plate at a speed of 26.82 m/s is defined to be 0.45 to 0.55.

The low compression Baseball defined in the rules of Little League has been described above. As for the medium compression Baseball, however, the hardness of the baseball is defined such that the load when the baseball is compressed by 6.35 mm is 75 to 150 lbf (333.62 to 667.23 N). In addition, the restitution coefficient of the baseball when the baseball hits against the iron plate at a speed of 26.82 m/s is defined to be 0.50 to 0.55.

An usual ball for hardball is configured by spherically winding a wool yarn on a rubber core, further winding a cotton yarn thereon to make a surface smooth, and putting a cow leather thereon and sewing up the leather with a sewing thread. It should be noted that a ball for hardball having a structure different from that of this usual ball for hardball is proposed. Japanese Patent Laying-Open No. 2002-210043, for example, proposes a ball for hardball configured by wrapping a rubber core in an intermediate core made of urethane foam.

In addition to the ball for hardball, a ball for rubber-ball baseball is used as the baseball. The ball for rubber-ball baseball does not have a core and is formed to be hollow. Because of this hollowness, the impact force of the ball for rubber-ball baseball is small, and thus, safety is ensured.

The ball for rubber-ball baseball is formed to be hollow to decrease the impact force, and thus, a high level of safety is ensured. However, since the ball for rubber-ball baseball is formed to be hollow to decrease the impact force, the hit distance is shorter than that of the ball for hardball. Therefore, when the ball for rubber-ball baseball is hit with a bat, the hit distance equal to that of the ball for hardball cannot be obtained.

In addition, the ball for hardball disclosed in the above publication is formed such that a feeling when the ball is hit is almost the same as that of the usual ball for hardball, although the rubber core is wrapped in the intermediate core made of urethane foam. Thus, the ball for hardball disclosed in the above publication has the impact force equal to that of the usual ball for hardball. Therefore, in the ball for hardball disclosed in the above publication, it is not assumed to further improve safety as compared with the usual ball for hardball.

SUMMARY OF THE INVENTION

The present invention has been made in light of the above problems, and an object of the present invention is to provide a baseball that achieves a high level of safety when the baseball hits against a human body and achieves a hit distance equal to and longer than that of a ball for hardball.

As a result of earnest study by the inventors of the present invention, the inventors of the present invention have found that the impact force and the reaction force can be decreased and the restitution coefficient can be increased by adjusting a proportion and material properties of an inner core and an outer core of a baseball. As a result, the inventors of the present invention have found that there can be realized a ball that achieves a high level of safety when the ball hits against a human body and flies well when the ball is hit with a bat. Based on these findings, the inventors of the present invention have found that there can be obtained a baseball that can achieve a high level of safety when the baseball hits against a human body by decreasing the impact force and the reaction force, and can achieve a hit distance equal to and longer than that of a ball for hardball by increasing the restitution coefficient.

A baseball according to the present invention is directed to a baseball including: an inner core; and an outer core covering an outer circumferential surface of the inner core, the inner core being formed to have a dimension of 20% or more and 80% or less of an outer diameter of the inner core and the outer core of the baseball, and having a dynamic viscoelasticity loss coefficient (tan δ) of 0.3 or less, the outer core being formed to have a thickness of 10% or more and 40% or less of the outer diameter of the inner core and the outer core of the baseball, and having an elastic modulus of 1.5 MPa or less.

The dynamic viscoelasticity loss coefficient (tan δ) herein is a ratio between a loss elastic modulus, which is an imaginary part of a complex elastic modulus, and a storage elastic modulus, which is a real part of the complex elastic modulus. The complex elastic modulus is a difference between dynamic stress and dynamic strain when sinusoidal vibrations are provided to a viscoelastic material.

The inventors of the present invention have found that there is a correlation between the dynamic viscoelasticity loss coefficient (tan δ) and the restitution coefficient, and that there is a correlation between the elastic modulus and the impact force. The inventors of the present invention have also found that the impact and reaction forces and the restitution coefficient vary depending on the proportion of the inner core and the outer core. Therefore, the inventors of the present invention have known that by adjusting the dynamic viscoelasticity loss coefficient (tan δ) of the inner core, the elastic modulus of the outer core, and the proportion of the inner core and the outer core, the impact force and the reaction force comparable to those of a ball for rubber-ball baseball as well as the hit distance equal to and longer than that of the ball for hardball are obtained.

Specifically, the inventors of the present invention have known that since the baseball includes the inner core formed to have a dimension of 20% or more and 80% or less of the outer diameter of the inner core and the outer core of the baseball and having a dynamic viscoelasticity loss coefficient (tan δ) of 0.3 or less, and the outer core formed to have a thickness of 10% or more and 40% or less of the outer diameter of the inner core and the outer core of the baseball and having an elastic modulus of 1.5 MPa or less, the impact force and the reaction force comparable to those of the ball for rubber-ball baseball as well as the hit distance equal to and longer than that of the ball for hardball are obtained. Therefore, according to the baseball of the present invention, safety when the baseball hits against a human body can be improved and the hit distance equal to and longer than that of the ball for hardball can be obtained.

Preferably, in the baseball as described above, a reaction force when the inner core and the outer core of the baseball hit at a speed of 26.82 m/s is 4300 N or less. As a result, the impact force and the reaction force comparable to those of the ball for rubber-ball baseball can be obtained. A soft material such as natural leather, artificial leather, synthetic leather, cloth, and knitted material is generally used in an outer layer of the baseball. Therefore, even a baseball configured by attaching the outer layer to the inner core and the outer core can achieve the impact force and the reaction force comparable to those of the ball for rubber-ball baseball.

Preferably, in the baseball as described above, a restitution coefficient when the baseball hits against an iron plate at a speed of 26.82 m/s is 0.50 or more. As a result, the hit distance equal to and longer than that of the ball for hardball can be obtained.

Preferably, in the baseball as described above, the restitution coefficient is 0.55 or less, and a load when the outer diameter of the baseball is compressed by 6.35 mm is less than 45 lbf. As a result, there can be provided a baseball satisfying the rules of Little League.

A baseball according to the present invention is directed to a baseball including: an inner core; and an outer core covering an outer circumferential surface of the inner core, the inner core having an elastic modulus of 1.0 MPa or more and 1.3 MPa or less, a dynamic viscoelasticity loss coefficient (tan δ) of 0.10 or more and 0.20 or less, and a diameter of 34 mm, the outer core having an elastic modulus of 0.6 MPa or more and 1.0 MPa or less, and a dynamic viscoelasticity loss coefficient (tan δ) of 0.26 or more and 0.30 or less, the baseball further including: a thread-wound layer configured by winding a thread to cover an outer circumferential surface of the outer core; and an outer layer covering an outer circumferential surface of the thread-wound layer, the inner core and the outer core of the baseball having an outer diameter of 70.7 mm.

Preferably, the inner core has an elastic modulus of 1.1 MPa and a dynamic viscoelasticity loss coefficient (tan δ) of 0.10, and the outer core has an elastic modulus of 0.95 MPa and a dynamic viscoelasticity loss coefficient (tan δ) of 0.26.

As a result, the inventors of the present invention have found that the impact force and the reaction force comparable to those of the ball for rubber-ball baseball as well as the hit distance equal to and longer than that of the ball for hardball are obtained. Therefore, according to the baseball of the present invention, safety when the baseball hits against a human body can be improved and the hit distance equal to and longer than that of the ball for hardball can be obtained.

As described above, according to the baseball of the present invention, safety when the baseball hits against a human body can be improved and the hit distance equal to and longer than that of the ball for hardball can be obtained.

A baseball according to another aspect of the present invention is directed to a baseball including: an inner core; and an outer core covering an outer circumferential surface of the inner core, the inner core being formed to have a dimension of 20% or more and 80% or less of an outer diameter of the inner core and the outer core of the baseball, and having a dynamic viscoelasticity loss coefficient (tan δ) lower than that of the outer core, the outer core being formed to have a thickness of 10% or more and 40% or less of the outer diameter of the inner core and the outer core of the baseball, and having an elastic modulus lower than that of the inner core.

The inventors of the present invention have known that by adjusting the dynamic viscoelasticity loss coefficient (tan δ) of the inner core, the elastic modulus of the outer core, and the proportion of the inner core and the outer core, the impact force and the reaction force can be made lower and the restitution coefficient can be made higher as compared with a single-layer core.

Specifically, it has been found that when the inner core is formed to have a dimension of 20% or more and 80% or less of the outer diameter of the inner core and the outer core of the baseball and has a dynamic viscoelasticity loss coefficient (tan δ) lower than that of the outer core, the restitution coefficient higher than that of the outer core only can be obtained. It has also been found that when the outer core is formed to have a thickness of 10% or more and 40% or less of the outer diameter of the inner core and the outer core of the baseball and has an elastic modulus lower than that of the inner core, the impact force lower than that of the inner core only can be obtained. As a result, the inventors of the present invention have known that safety when the baseball hits against a human body as well as the hit distance of the baseball can be freely adjusted.

Preferably, in the baseball according to another aspect of the present invention as described above, the inner core has the dynamic viscoelasticity loss coefficient (tan δ) of 0.3 or less.

When the inner core is formed to have a dimension of 20% or more and 80% or less of the outer diameter of the inner core and the outer core of the baseball and has a dynamic viscoelasticity loss coefficient (tan δ) of 0.3 or less, the restitution coefficient equal to or higher than that of the ball for hardball can be obtained. When the outer core is formed to have a thickness of 10% or more and 40% or less of the outer diameter of the inner core and the outer core of the baseball and has an elastic modulus lower than that of the inner core, the impact force and the reaction force lower than those of the ball for hardball can be obtained. As a result, safety when the baseball hits against a human body can be further improved as compared with the ball for hardball, and the hit distance equal to and longer than that of the ball for hardball can be obtained.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described hereinafter with reference to the drawings.

Figure 1:
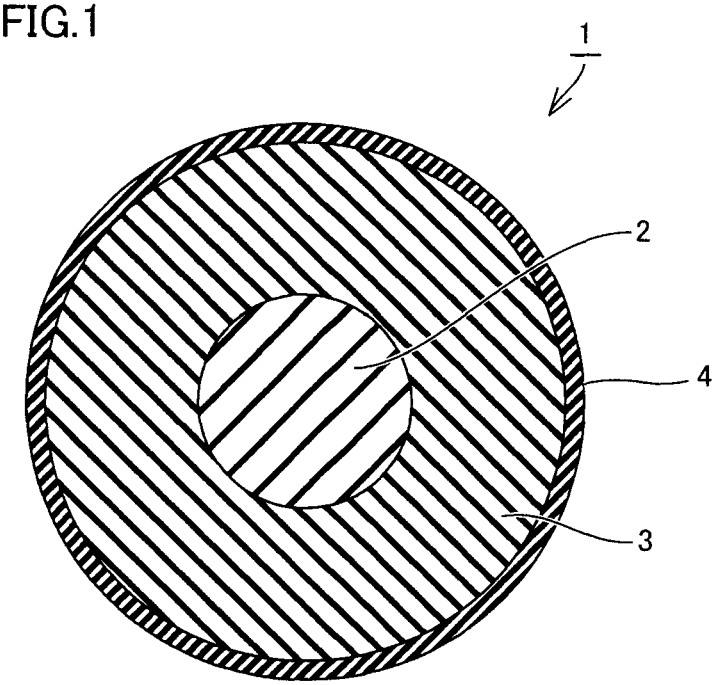
FIG. 1 is a schematic cross-sectional view of a baseball according to an embodiment of the present invention.

Referring to FIG. 1, a baseball 1 according to an embodiment of the present invention mainly has an inner core 2, an outer core 3 and an outer layer 4. Inner core 2 is placed in a central portion of baseball 1. An outer circumferential surface of inner core 2 is covered with outer core 3. An outer circumferential surface of outer core 3 is covered with outer layer 4. Inner core 2 and outer core 3 are made of, for example, urethane foam.

Inner core 2 is formed to have a dimension of 20% or more and 80% or less of an outer diameter of inner core 2 and outer core 3 of baseball 1, and has a dynamic viscoelasticity loss coefficient (tan δ) of 0.3 or less. Outer core 3 is formed to have a thickness of 10% or more and 40% or less of the outer diameter of inner core 2 and outer core 3 of baseball 1, and has an elastic modulus of 1.5 MPa or less.

The thickness of outer core 3 corresponds to a length from an outer diameter of inner core 2 to an outer diameter of outer core 3 in a radial direction of baseball 1. Outer layer 4 mainly has, for example, leather and a sewing thread for sewing up this leather. Outer layer 4 is configured by putting the leather over the outer circumferential surface of outer core 3 and sewing up this leather.

The reaction force of baseball 1 when inner core 2 and outer core 3 of baseball 1 hit at a speed of 26.82 m/s may be 4300 N or less.

The restitution coefficient of baseball 1 when baseball 1 hits against an iron plate at a speed of 26.82 m/s may be 0.50 or more. It should be noted that a value of the restitution coefficient of baseball 1 decreases slightly due to outer layer 4. Specifically, a value of the restitution coefficient decreases by a value within the range of 0.01 to 0.02, e.g., by approximately 0.015. Therefore, the restitution coefficient of inner core 2 and outer core 3 of baseball 1 when inner core 2 and outer core 3 of baseball 1 hit against the iron plate at a speed of 26.82 m/s may be 0.515 or more.

The restitution coefficient of baseball 1 may be 0.55 or less, and a load when the outer diameter of baseball 1 is compressed by 6.35 mm may be less than 45 lbf (200.17 N).

Figure 2:
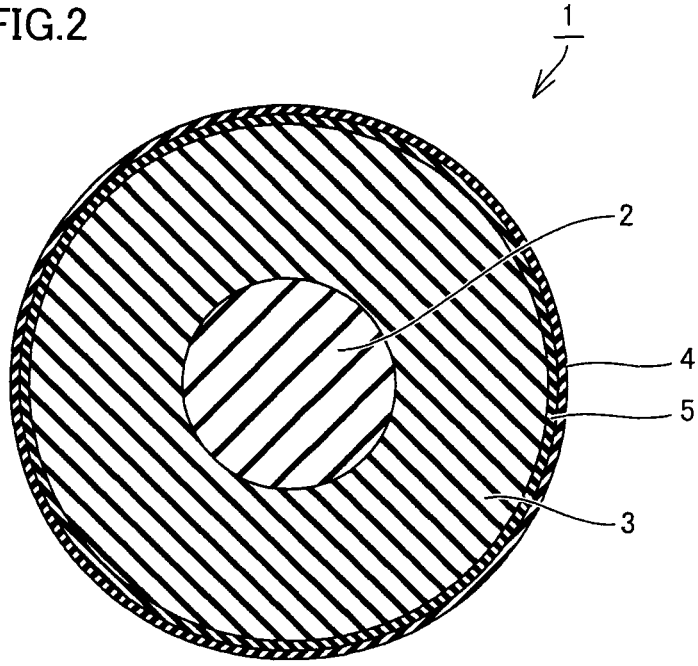
FIG. 2 is a schematic cross-sectional view of a first modification of the baseball according to the embodiment of the present invention.

Referring to FIG. 2, baseball 1 according to a first modification of the embodiment of the present invention may have a thread-wound layer 5 configured by winding a thread to cover the outer circumferential surface of outer core 3. Thread-wound layer 5 is configured by winding, for example, a cotton yarn to cover the outer circumferential surface of outer core 3 to make a surface thereof smooth. It should be noted that when thread-wound layer 5 is wound, inner core 2 and outer core 3 become a little smaller due to tension when the thread is wound, and thus, the outer diameter after the thread is wound is almost the same as the outer diameter of outer core 3.

Referring to FIG. 2, inner core 2 has an elastic modulus of 1.0 MPa or more and 1.3 MPa or less, a dynamic viscoelasticity loss coefficient (tan δ) of 0.10 or more and 0.20 or less, and a diameter of 34 mm. Outer core 3 has an elastic modulus of 0.6 MPa or more and 1.0 MPa or less, and a dynamic viscoelasticity loss coefficient (tan δ) of 0.26 or more and 0.30 or less. In thread-wound layer 5, the thread is wound to cover the outer circumferential surface of outer core 3. Outer layer 4 is provided to cover an outer circumferential surface of thread-wound layer 5. Inner core 2 and outer core 3 of baseball 1 have an outer diameter of 70.7 mm. Inner core 2 and outer core 3 constitute a core of baseball 1. The outer diameter of the core of baseball 1 corresponds to the outer diameter of outer core 3. It should be noted that baseball 1 configured by affixing leather to the core of baseball 1 and sewing up the leather with a sewing thread has an outer circumference of, for example, 230 mm and an outer diameter of, for example, 73.2 mm.

Preferably, inner core 2 has an elastic modulus of 1.1 MPa and a dynamic viscoelasticity loss coefficient (tan δ) of 0.10, and outer core 3 has an elastic modulus of 0.95 MPa and a dynamic viscoelasticity loss coefficient (tan δ) of 0.26.

It should be noted that the outer diameter of the core formed by inner core 2 and outer core 3 of baseball 1, i.e., 70.7 mm, and the diameter of inner core 2, i.e., 34 mm, have a dimension tolerance of ±0.2 mm, respectively. In the following, each dimension has a dimension tolerance, similarly.

Figure 3:
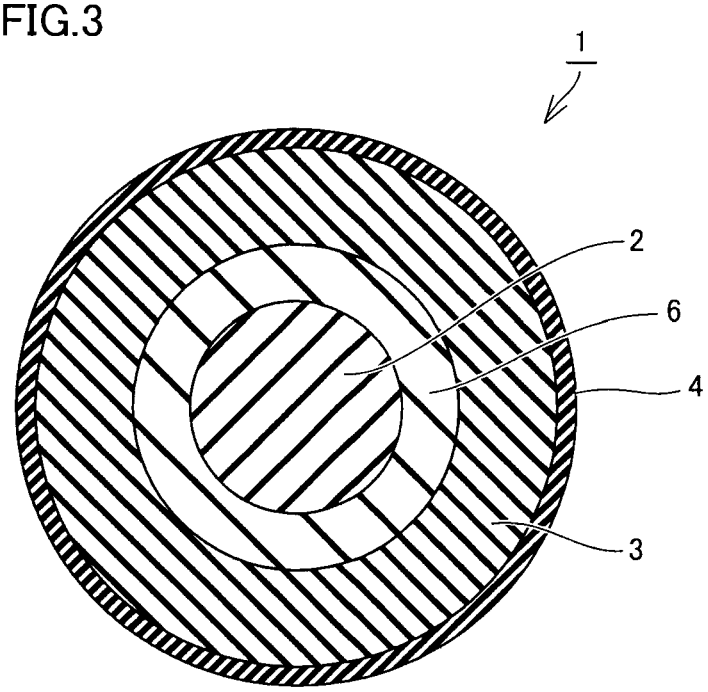
FIG. 3 is a schematic cross-sectional view of a second modification of the baseball according to the embodiment of the present invention.

Referring to FIG. 3, in baseball 1 according to a second modification of the embodiment of the present invention, the core inside outer layer 4 may be formed of three layers. In this second modification, a middle core 6 is provided to cover the outer circumferential surface of inner core 2. Outer core 3 is provided to cover an outer circumferential surface of middle core 6.

Inner core 2 has an elastic modulus of 1.0 MPa or more and 1.3 MPa or less. Inner core 2 preferably has an elastic modulus of 1.1 MPa. Inner core 2 has a dynamic viscoelasticity loss coefficient (tan δ) of 0.10 or more and 0.20 or less. Inner core 2 preferably has a dynamic viscoelasticity loss coefficient (tan δ) of 0.10. Inner core 2 has a thickness of 34 mm.

Middle core 6 has an elastic modulus of 0.6 MPa or more and 1.0 MPa or less. Middle core 6 preferably has an elastic modulus of 0.60 MPa. Middle core 6 has a dynamic viscoelasticity loss coefficient (tan δ) of 0.26 or more and 0.30 or less. Middle core 6 preferably has a dynamic viscoelasticity loss coefficient (tan δ) of 0.30. Middle core 6 has a thickness of 2 mm.

Outer core 3 has an elastic modulus of 0.6 MPa or more and 1.0 MPa or less. Outer core 3 preferably has an elastic modulus of 0.95 MPa. Outer core 3 has a dynamic viscoelasticity loss coefficient (tan δ) of 0.26 or more and 0.30 or less. Outer core 3 preferably has a dynamic viscoelasticity loss coefficient (tan δ) of 0.26. Outer core 3 has a thickness of 16.35 mm.

Inner core 2, outer core 3 and middle core 6 are made of, for example, urethane foam.

It should be noted that thread-wound layer 5 may be provided as in the above-mentioned first modification. In this case, in thread-wound layer 5, the thread is wound to cover the outer circumferential surface of outer core 3.

Next, a description will be given to functions and effects of the baseball according to the embodiment of the present invention.

The inventors of the present invention have found that there is a correlation between the dynamic viscoelasticity loss coefficient (tan δ) and the restitution coefficient, and that there is a correlation between the elastic modulus and the impact force. The inventors of the present invention have also found that the impact and reaction forces and the restitution coefficient vary depending on the proportion of inner core 2 and outer core 3.

As a result of study by the inventors of the present invention, the reaction force when a ball for rubber-ball baseball hits at a speed of 26.82 m/s is approximately 4300 N. Therefore, the reaction force when baseball 1 hits at a speed of 26.82 m/s must be approximately 4300 N or less. In addition, according to the rules of Little League, the restitution coefficient of the ball for hardball is defined to be 0.45 to 0.55. In order to extend the hit distance, baseball 1 preferably has a restitution coefficient of 0.50 or more, which is higher than that of the ball for rubber-ball baseball.

Baseball 1 according to the embodiment of the present invention includes inner core 2 formed to have a dimension of 20% or more and 80% or less of the outer diameter of inner core 2 and outer core 3 of baseball 1 and having a dynamic viscoelasticity loss coefficient (tan δ) of 0.3 or less, and outer core 3 formed to have a thickness of 10% or more and 40% or less of the outer diameter of inner core 2 and outer core 3 of baseball 1 and having an elastic modulus of 1.5 MPa or less.

The inventors of the present invention have found that when inner core 2 has a dynamic viscoelasticity loss coefficient (tan δ) of 0.3 or less, the restitution coefficient becomes 0.50 or more. The inventors of the present invention have further found that when the proportion of inner core 2 is 20% or more of the outer diameter of the core formed by inner core 2 and outer core 3 of baseball 1, the restitution coefficient increases. The inventors of the present invention have also found that when outer core 3 has an elastic modulus of 1.5 MPa or less, the impact force is approximately 80 G. The inventors of the present invention have also found that when outer core 3 has a thickness of 10% (proportion: 20%) or more of the outer diameter of the core formed by inner core 2 and outer core 3 of baseball 1, the restitution coefficient increases.

As a result, the inventors of the present invention have found that the reaction force when baseball 1 hits at a speed of 26.82 m/s becomes approximately 4300 N or less and the restitution coefficient becomes 0.50 or more. Therefore, the inventors of the present invention have known that according to baseball 1 in the embodiment of the present invention, the impact force and the reaction force comparable to those of the ball for rubber-ball baseball as well as the hit distance longer than that of the ball for rubber-ball baseball are obtained, and the hit distance equal to and longer than that of the ball for hardball is obtained.

Therefore, according to baseball 1 in the embodiment of the present invention, the impact force and the reaction force when baseball 1 hits against a human body are comparable to those of the ball for rubber-ball baseball, and thus, safety can be improved like the ball for rubber-ball baseball. In addition, since the restitution coefficient is equal to and higher than that of the ball for hardball, the hit distance equal to and longer than that of the ball for hardball can be obtained. Therefore, according to baseball 1 in the embodiment of the present invention, safety when baseball 1 hits against a human body can be improved and the hit distance equal to and longer than that of the ball for hardball can be obtained.

The reaction force of baseball 1 according to the embodiment of the present invention when inner core 2 and outer core 3 of baseball 1 hit at a speed of 26.82 m/s may be 4300 N or less. This reaction force of 4300 N corresponds to the reaction force of the ball for rubber-ball baseball. Therefore, the reaction force comparable to that of the ball for rubber-ball baseball can be obtained. This 4300 N corresponds to the impact force of about 80 G. Since the impact force of the ball for rubber-ball baseball can be assumed to be about 80 G, the impact force and the reaction force comparable to those of the ball for rubber-ball baseball can also be obtained.

The restitution coefficient of baseball 1 according to the embodiment of the present invention when baseball 1 hits against the iron plate at a speed of 26.82 m/s may be 0.50 or more. This restitution coefficient of 0.50 matches the restitution coefficient of the ball for hardball defined in the rules of Little League, i.e., 0.45 to 0.55. Therefore, the hit distance equal to and longer than that of the ball for hardball can be obtained.

In baseball 1 according to the embodiment of the present invention, the restitution coefficient may be 0.55 or less, and the load when the outer diameter of baseball 1 is compressed by 6.35 mm may be less than 45 lbf (200.17 N). According to the rules of Little League, the restitution coefficient is defined to be 0.45 to 0.55 and the load when the outer diameter of baseball 1 is compressed by 6.35 mm is defined to be less than 45 lbf (200.17 N). Since baseball 1 according to the embodiment of the present invention conforms to these rules of Little League, there can be provided a baseball satisfying the rules of Little League.

The baseball according to the present invention is directed to baseball 1 including inner core 2 and outer core 3 covering the outer circumferential surface of inner core 2, inner core 2 having an elastic modulus of 1.0 MPa or more and 1.3 MPa or less, a dynamic viscoelasticity loss coefficient (tan δ) of 0.10 or more and 0.20 or less, and a diameter of 34 mm, outer core 3 having an elastic modulus of 0.6 MPa or more and 1.0 MPa or less, and a dynamic viscoelasticity loss coefficient (tan δ) of 0.26 or more and 0.30 or less. Baseball 1 further includes thread-wound layer 5 configured by winding the thread to cover the outer circumferential surface of outer core 3, and outer layer 4 covering the outer circumferential surface of thread-wound layer 5. Inner core 2 and outer core 3 of baseball 1 has an outer diameter of 70.7 mm.

Preferably, the inner core has an elastic modulus of 1.1 MPa and a dynamic viscoelasticity loss coefficient (tan δ) of 0.10, and the outer core has an elastic modulus of 0.95 MPa and a dynamic viscoelasticity loss coefficient (tan δ) of 0.26.

As a result, the inventors of the present invention have known that the impact force and the reaction force comparable to those of the ball for rubber-ball baseball as well as the hit distance equal to and longer than that of the ball for hardball can be obtained. Therefore, according to the baseball of the present invention, safety when the baseball hits against a human body can be improved and the hit distance equal to and longer than that of the ball for hardball can be obtained.

EXAMPLE

An example of the present invention will be described hereinafter. The portions that are the same as or corresponding to those in the above are denoted with the same reference characters, and description thereof may not be repeated.

Here, it was examined whether it was possible or not to decrease the impact force and the reaction force of the baseball and to increase the restitution coefficient.

Figure 5:
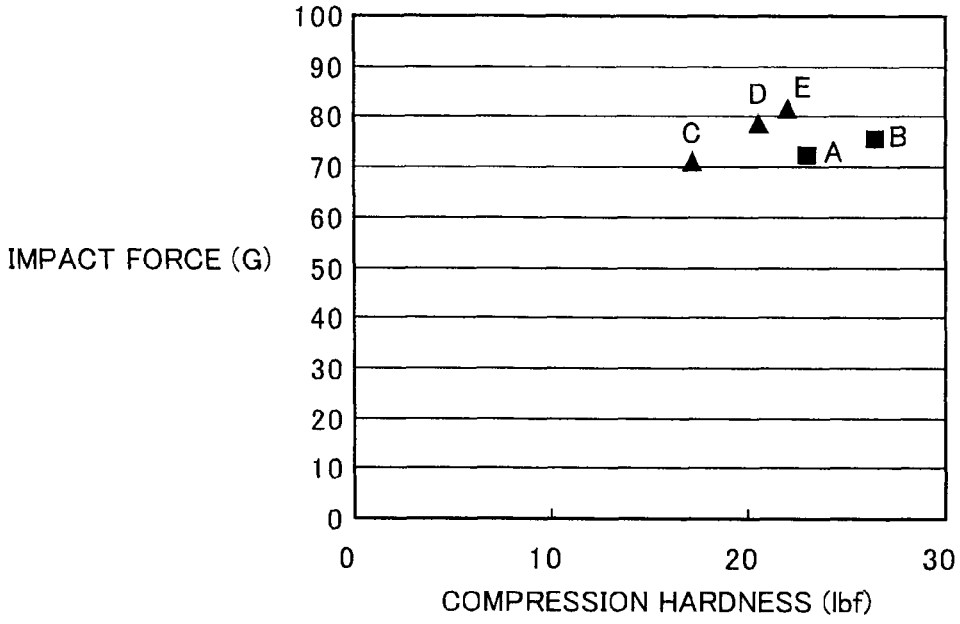
FIG. 5 shows a relationship between impact force and compression hardness in Comparative Examples and Examples in the example.
Figure 6:
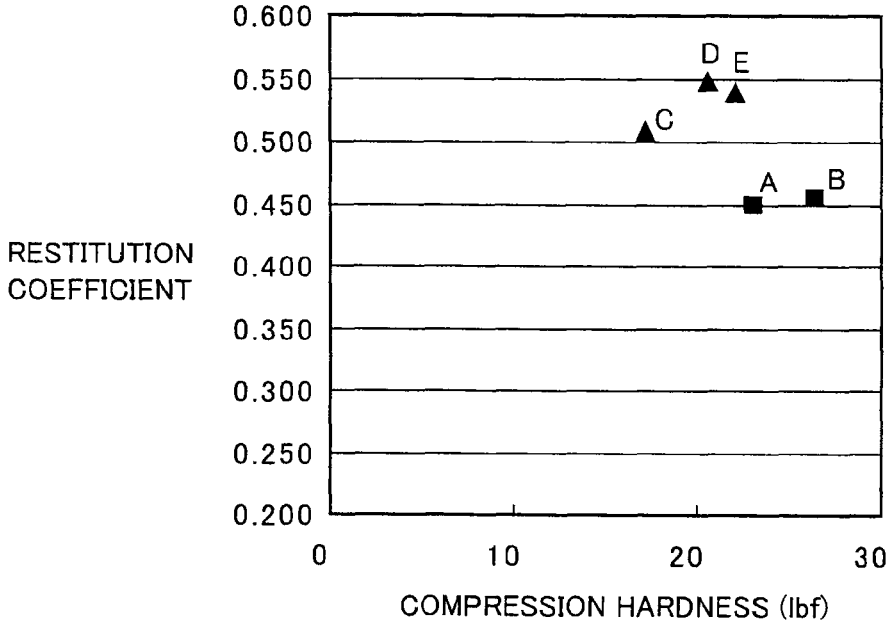
FIG. 6 shows a relationship between restitution coefficient and compression hardness in Comparative Examples and Examples in the example.

Referring to Table 1, FIGS. 5 and 6, Comparative Examples A, B and C are comparative examples for the present invention. Example D is an example of the present invention. Example E is a modification of the present invention. A vertical axis in FIG. 5 indicates the magnitude of impact force (G) and a horizontal axis indicates the magnitude of compression hardness (lbf). A vertical axis in FIG. 6 indicates the magnitude of restitution coefficient and a horizontal axis indicates the magnitude of compression hardness (lbf).

TABLE 1

| | compression hardness (lbf) | restitution coefficient | impact force (G) |
|---|---|---|---|
| Comparative Example A | 23.1 | 0.450 | 72.1 |
| Comparative Example B | 26.5 | 0.455 | 75.5 |
| Comparative Example C | 17.1 | 0.509 | 71.0 |
| Example D | 20.5 | 0.548 | 78.7 |
| Example E | 22.0 | 0.540 | 81.6 |

Figure 4:
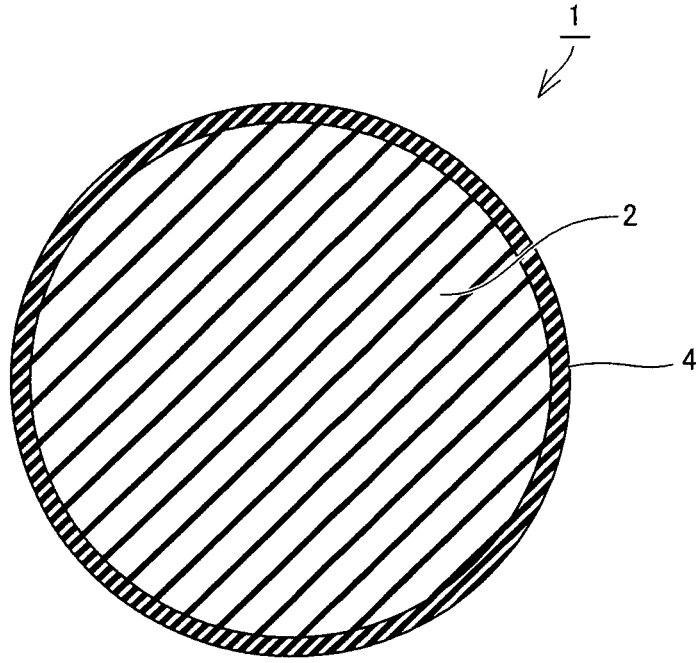
FIG. 4 is a schematic cross-sectional view of a baseball in Comparative Example in an example.

In Comparative Examples A and B, the ball for rubber-ball baseball is used. Referring to FIG. 4, baseball 1 in Comparative Example C has such a structure that the core inside outer layer 4 is formed of a single layer. Baseball 1 in Comparative Example C does not have outer core 3 and outer layer 4 is provided to cover the outer circumferential surface of inner core 2. In Comparative Example C, baseball 1 is made of urethane foam. In Examples D and E, the baseball according to the present invention is used, and the core thereof has an outer diameter of 70.7 mm. The baseball in each of Examples D and E has such a structure that the core is formed of two layers as shown in FIG. 2. In Examples D and E, the inner core has a diameter of 34 mm. In Examples D and E, the inner core and the outer core are made of urethane foam.

Each item in Table 1 will be described. The compression hardness (lbf) refers to the load when the outer diameter of the baseball is compressed by 6.35 mm. The restitution coefficient refers to the restitution coefficient when the baseball hits against the iron plate at a speed of 26.82 m/s. The impact force (G) refers to the impact force when the baseball hits at a speed of 26.82 m/s. As to these items, the same is applied in each table and each figure in the following.

The compression hardness (lbf) was measured by using AG-5000D manufactured by Shimadzu Corporation as a measuring instrument, in accordance with a test method based on ASTM (American Society for Testing and Materials) F 1888 "Test Method for Compression-Displacement of Baseballs and Softballs."

The restitution coefficient was measured by using a light gate as a measuring instrument, in accordance with a test method based on ASTM F 1887 "Standard Test Method for Measuring the Coefficient of restitution (COR) of Baseballs and Softballs." The light gate is a measuring instrument for calculating speed by sensing the passage of a ball through a box from which light is emitted. The restitution coefficient is a value obtained by dividing the speed of the ball after hitting against an iron plate by the speed of the ball before hitting against the iron plate.

The impact force (G) was measured by using a testing machine based on "Approval Standard and Standard Confirmation Method for Baseball Helmets" by the Consumer Product Safety Association to measure acceleration when a ball hits against a dummy head by an accelerometer attached to the dummy head.

Referring to Table 1, FIGS. 5 and 6, values of the compression hardness (lbf) in Examples D and E were equal to and smaller than those in Comparative Examples A and B. Values of the restitution coefficient in Examples D and E were larger than those in Comparative Examples A, B and C. Values of the impact force (G) in Examples D and E were close to those in Comparative Examples A, B and C. The restitution coefficient was 0.540 to 0.548 in Examples D and E. In addition, the impact force (G) was 78.7 to 81.6 in Examples D and E.

Figure 7:
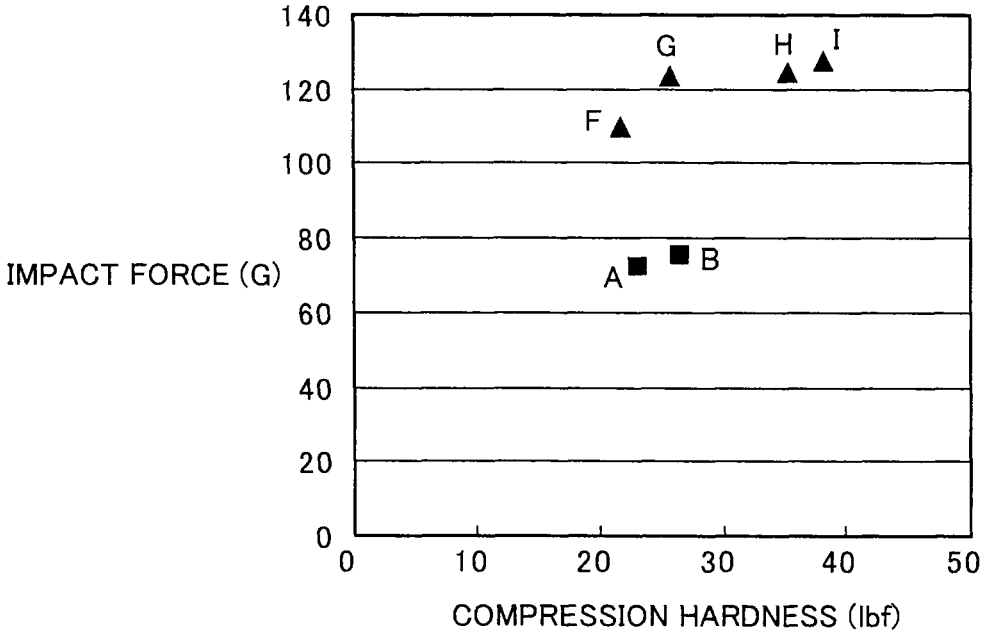
FIG. 7 shows a relationship between impact force and compression hardness in Comparative Examples in the example.
Figure 8:
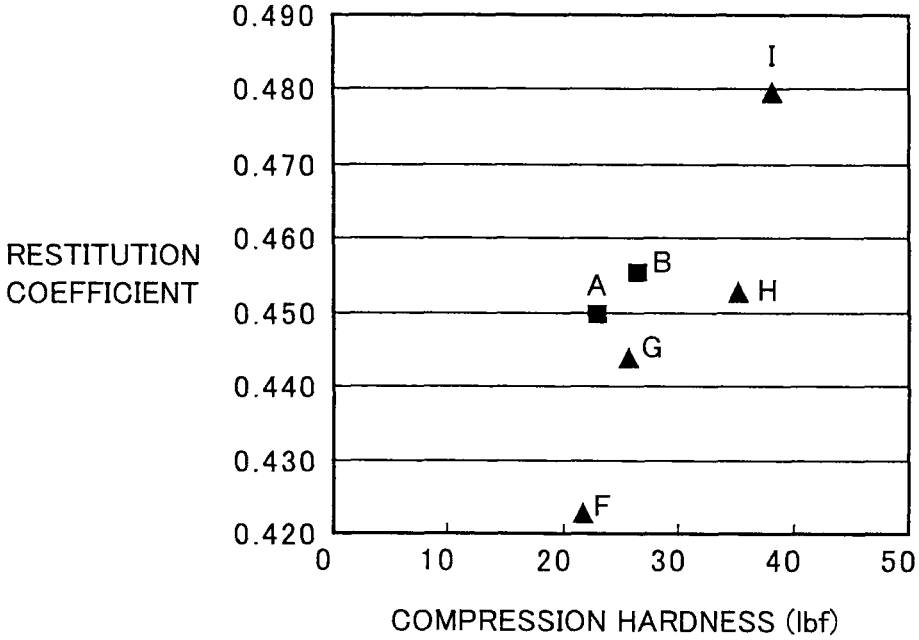
FIG. 8 shows a relationship between restitution coefficient and compression hardness in Comparative Examples in the example.

Referring to Table 2, FIGS. 7 and 8, Comparative Examples F to I are comparative examples for the present invention. A vertical axis in FIG. 7 indicates the magnitude of impact force (G) and a horizontal axis indicates the magnitude of compression hardness (lbf). A vertical axis in FIG. 8 indicates the magnitude of restitution coefficient and a horizontal axis indicates the magnitude of compression hardness (lbf). In Comparative Examples F to I, the core has an outer diameter of 70.7 mm and is formed of a single layer as shown in FIG. 4. In Comparative Examples F to I, the core is made of urethane foam.

TABLE 2

| | compression hardness (lbf) | restitution coefficient | impact force (G) |
|---|---|---|---|
| Comparative Example A | 23.1 | 0.450 | 72.1 |
| Comparative Example B | 26.5 | 0.455 | 75.5 |
| Comparative Example F | 21.6 | 0.423 | 109.6 |
| Comparative Example G | 25.6 | 0.444 | 123.2 |
| Comparative Example H | 35.3 | 0.453 | 124.5 |
| Comparative Example I | 38.3 | 0.480 | 127.3 |

Values of the compression hardness (lbf) in Comparative Examples F and G were equal to those in Comparative Examples A and B, and values of the compression hardness (lbf) in Comparative Examples H and I were larger than those in Comparative Examples A and B. In addition, it was found that a value of the impact force (G) did not change easily as compared with the compression hardness (lbf) in Comparative Examples F to I. More specifically, it was found that a rate of decrease in the impact force (G) was smaller than a rate of decrease in the compression hardness (lbf). Values of the restitution coefficient in Comparative Examples F to I were equal to those in Comparative Examples A and B. Values of the impact force (G) in Comparative Examples F to I were much larger than those in Comparative Examples A and B.

As a result, it was found that when the baseball having the single-layer core structure had a restitution coefficient equal to that of the ball for rubber-ball baseball, the impact force (G) became much larger than that of the ball for rubber-ball baseball.

Next, properties of the material used in the core were specified.

First, in order to obtain the properties of the material used in the core, CAE (Computer Aided Engineering) analysis was carried out using an SS curve based on drop impact and a viscoelasticity value obtained by a viscoelasticity test.

In the CAE analysis, an Ogden coefficient (elasticity) and a relaxation function (viscosity) were used as parameters to be inputted. A weight-drop test and a dynamic viscoelasticity test were used to calculate the parameters. The elasticity was measured by the weight-drop test, and the viscosity was measured by the dynamic viscoelasticity test.

The weight-drop test was conducted using a buffer impact tester CST-180 manufactured by Yoshida Seiki Co., Ltd. A test method is as follows. First, a sample having a thickness of 20 mm was prepared. Next, a weight having an outer diameter of 45 mm and a certain weight was dropped onto the sample from a certain height to measure a displacement-acceleration curve using an accelerometer. Then, a stress-strain curve was calculated from the displacement-acceleration curve. Coefficients μ and α of a strain energy function were calculated from this stress-strain curve based on an equation (1). "μ" refers to a shear elastic modulus and "α" refers to an exponent. In addition, "λ" in equation (1) refers to an extension ratio, "K" refers to a volume elasticity coefficient and "J" refers to a volume change rate.

[equation 1]

$$W = \sum_{A=1}^{3}\sum_{i=1}^{n} 2\frac{\mu_i}{\alpha_i}(\lambda_A^{\alpha i} - 1) + \frac{K}{2}(J-1)^2 \quad (1)$$

The elastic modulus was calculated using μ and α based on an equation (2). More specifically, an initial elastic modulus in the stress-strain curve was calculated.

[equation 2]

$$E = \frac{3}{2}\sum_{n=1}^{N}\alpha_n\mu \quad (2)$$

The dynamic viscoelasticity test was conducted using Rheogel-E4000 manufactured by UBM. A test method is as follows. Stress was measured from strain of sinusoidal vibration. In addition, temperature characteristics and frequency characteristics were measured by measuring a phase difference between input strain and response stress.

Then, a complex elastic modulus was measured from an amplitude ratio and a phase difference between a drive unit and a response unit at 20° C. when forced vibration was produced at frequencies of 1, 2, 4, 8, and 16 Hz in a frequency-temperature dependence mode and the temperature was raised at 2° C./min. From a result of this measurement, a coefficient of the relaxation function was calculated based on an equation (3) using a curve fit program manufactured by Mechanical Design Co. "g" in equation (3) refers to the relaxation function, "γ" refers to a relaxation shear elastic modulus and "τ" refers to a relaxation time.

[equation 3]

$$g(t)_{PAM} = \sum_{i=1}^{M}\gamma_i e^{-\frac{t}{\tau_i}} \quad (3)$$

The complex elastic modulus will now be described. First, as shown in an equation (4), the elastic modulus is a ratio between stress σ and strain ϵ (Hooke's law). The complex elastic modulus is a dynamic value of the material properties considering energy lost as heat at the time of deformation and recovery. As shown in an equation (5), complex elastic modulus E* is a sum of storage elastic modulus E' and loss elastic modulus E".

[equation 4]

$$E^* = \frac{\sigma}{\varepsilon} \quad (4)$$

[equation 5]

$$E^* = E' + iE'' \quad (5)$$

Subsequently, it was checked whether or not there was a correlation between an actually measured value and an analytical value, and the properties of the material used in the core were specified. Referring to Table 3 and FIG. 9, samples I to IV were used to examine whether or not there was a correlation between an actually measured value and an analytical value of the restitution coefficient. A vertical axis in FIG. 9 indicates the magnitude of restitution coefficient (analytical) and a horizontal axis indicates the magnitude of restitution coefficient (actually measured). The actually measured value of the restitution coefficient is a value obtained by actually measuring the restitution coefficient when the baseball hits against the iron plate at a speed of 26.82 m/s. The analytical value of the restitution coefficient is a value of the restitution coefficient obtained by analysis with analysis software PAM CRASH manufactured by ESI Japan Ltd.

TABLE 3

| material | impact force (G) (actually measured) | reaction force (kN) (analytical) | restitution coefficient (actually measured) | restitution coefficient (analytical) |
|---|---|---|---|---|
| sample I | 86.0 | 4.42 | 0.638 | 0.659 |
| sample II | 106.0 | 4.72 | 0.594 | 0.611 |
| sample III | 78.0 | 4.29 | 0.519 | 0.525 |
| sample IV | 71.0 | 3.85 | 0.509 | 0.507 |

The core of each of samples I to IV has an outer diameter of 70.7 mm and is formed of a single layer as shown in FIG. 3. The core of each of samples I to IV is made of urethane foam.

Figure 9:
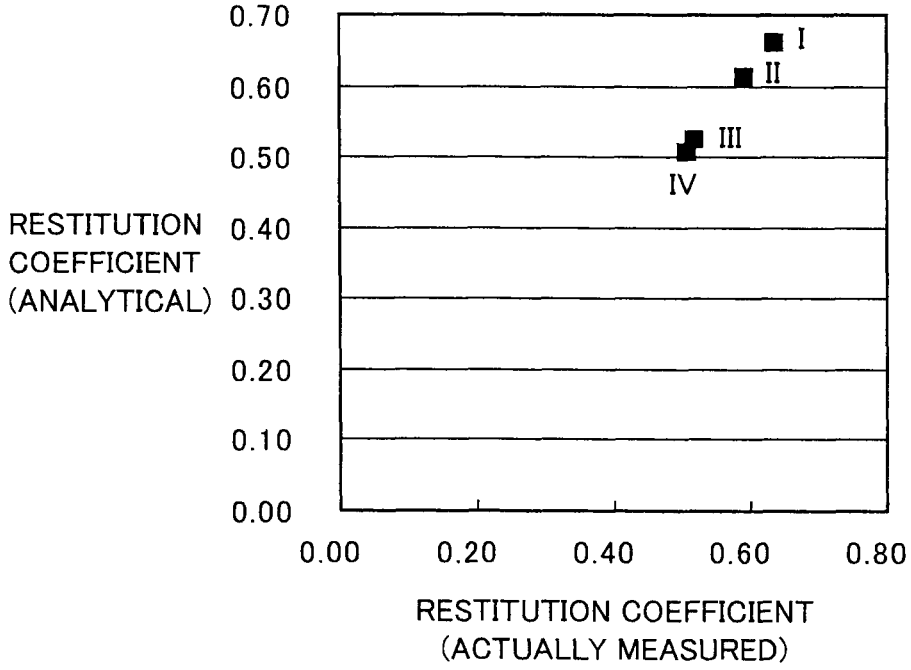
FIG. 9 shows a relationship between restitution coefficient (analytical) and restitution coefficient (actually measured) of samples in the example.

As shown in Table 3 and FIG. 9, it was found that in samples I to IV, the restitution coefficient (analytical), which is the analytical value of the restitution coefficient, was very close to the restitution coefficient (actually measured), which is the actually measured value of the restitution coefficient, and there was a correlation therebetween. As a result, it was found that there was a correlation between the actually measured value and the analytical value. Therefore, it was confirmed that measurement was possible using the analytical value, not the actually measured value.

Figure 10:
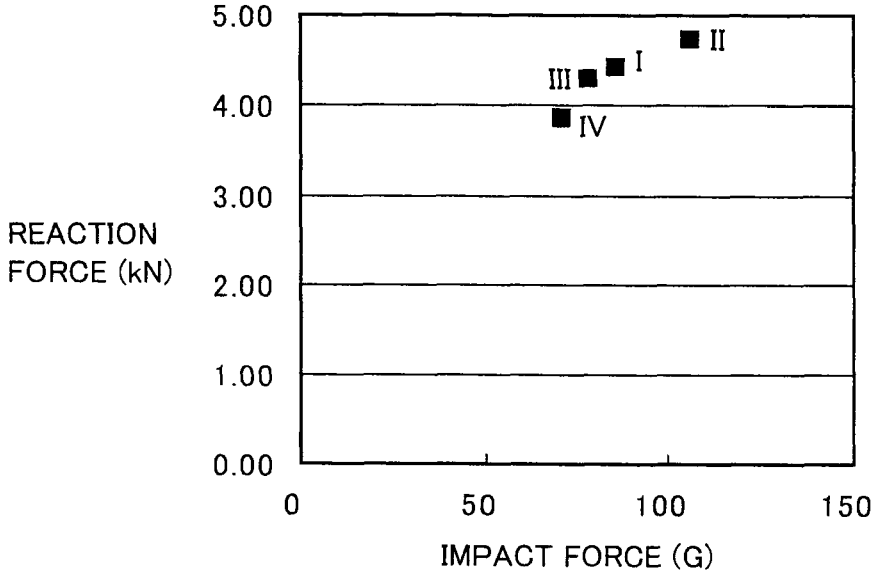
FIG. 10 shows a relationship between reaction force and impact force of the samples in the example.

Referring to Table 3 and FIG. 10, the impact force (G) is an actually measured value when the baseball hits at a speed of 26.82 m/s. The reaction force (kN) is a value obtained by analysis with the analysis software PAM CRASH manufactured by ESI Japan Ltd. A vertical axis in FIG. 10 indicates the magnitude of reaction force (kN) and a horizontal axis indicates the magnitude of impact force (G). It was found that in samples I to IV, there was a correlation between the impact force (G), which is the actually measured value, and the reaction force (kN), which is the analytical value. It was also found that the reaction force might only be approximately 4.3 kN in order to achieve the impact force of approximately 80 G comparable to that of the ball for rubber-ball baseball.

Subsequently, the properties of a plurality of materials were examined.

Referring to FIGS. 11 to 16, a relationship among the restitution coefficient, the impact force, the elastic modulus, the complex elastic modulus, and tan δ (loss coefficient) was examined for samples 1 to 7 shown in Table 4. Tan δ is a ratio between storage elastic modulus E' and loss elastic modulus E" in complex elastic modulus E* as described above.

TABLE 4

| | restitution coefficient (analytical) | reaction force (kN) | restitution coefficient (actually measured) | impact force (G) | elastic modulus (MPa) | complex elastic modulus (MPa) | tanδ | compression hardness (lbf) |
|---|---|---|---|---|---|---|---|---|
| sample 1 | 0.659 | 4.42 | 0.651 | 86.6 | 1.10 | 10.5 | 0.1 | 27.5 |
| sample 2 | 0.611 | 4.72 | 0.594 | 105.7 | 3.31 | 5.25 | 0.17 | 45.6 |
| sample 3 | 0.533 | 4.22 | 0.405 | 76.1 | 0.90 | 1.4 | 0.722 | 17.7 |
| sample 4 | 0.525 | 4.29 | 0.519 | 73.0 | 0.95 | 2.8 | 0.26 | 27.5 |
| sample 5 | 0.507 | 3.85 | 0.509 | 71.0 | 0.60 | 1.75 | 0.299 | 17.1 |
| sample 6 | 0.49 | 3.95 | 0.462 | 75.9 | 0.66 | 1.4 | 0.38 | 16.0 |
| sample 7 | 0.68 | 4.87 | 0.576 | 81.0 | 1.27 | 2.75 | 0.18 | 21.5 |

Figure 11:
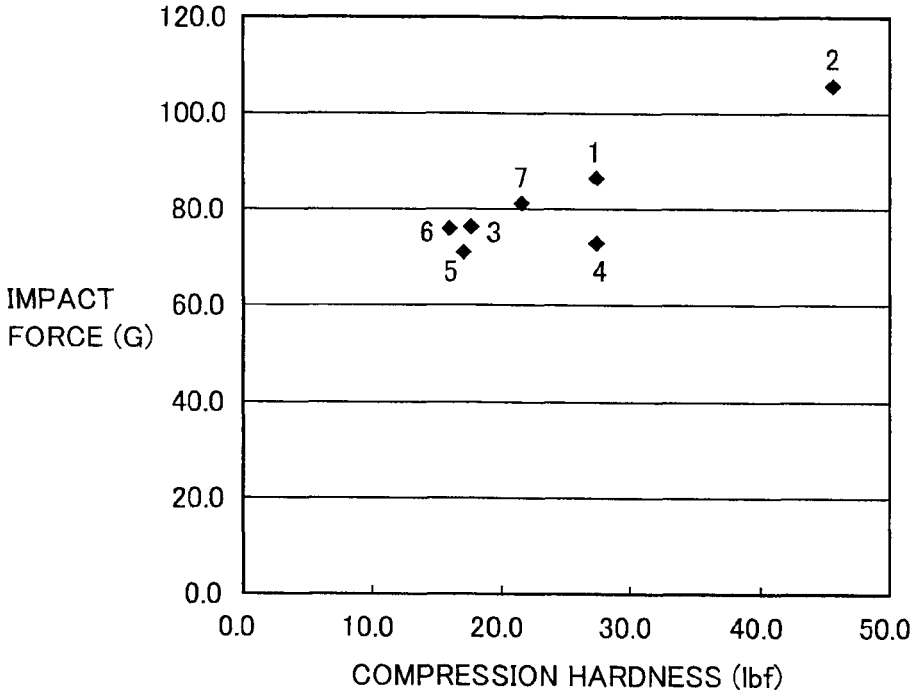
FIG. 11 shows a relationship between impact force and compression hardness of the samples in the example.
Figure 12:
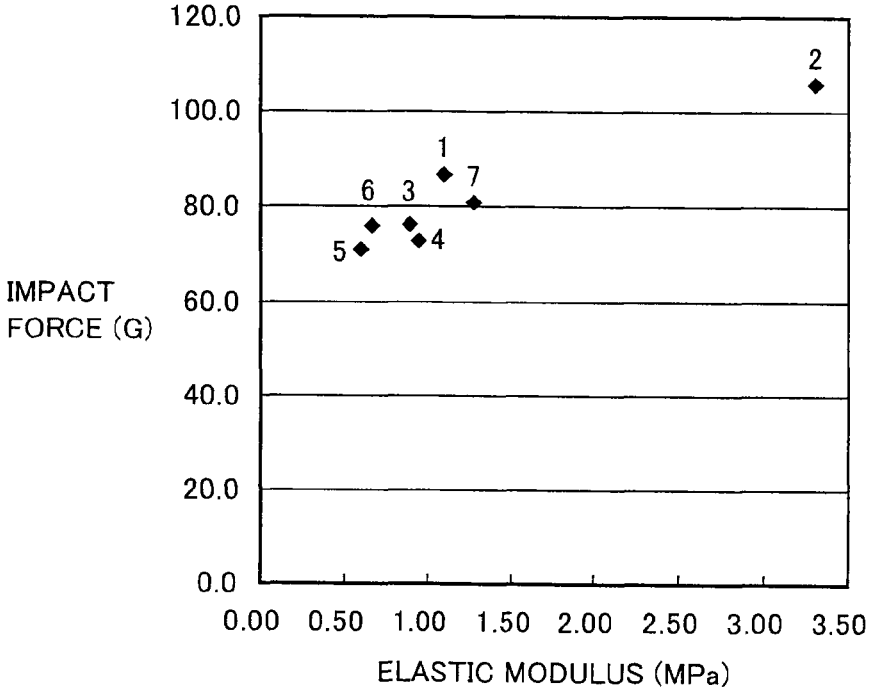
FIG. 12 shows a relationship between impact force and elastic modulus of the samples in the example.

Referring to FIG. 11, it was found that there was no correlation between the impact force (G) and the compression hardness (lbf) in samples 1 to 7. A vertical axis in FIG. 11 indicates the magnitude of impact force (G) and a horizontal axis indicates the magnitude of compression hardness (lbf). On the other hand, referring to FIG. 12, it was found that there was a correlation between the impact force (G) and the elastic modulus (MPa) in samples 1 to 7. A vertical axis in FIG. 12 indicates the magnitude of impact force (G) and a horizontal axis indicates the magnitude of elastic modulus (MPa). It was found that when the elastic modulus (MPa) was within 0.5 to 1.5 MPa, the impact force of approximately 80 G comparable to that of the ball for rubber-ball baseball was obtained.

Figure 13:
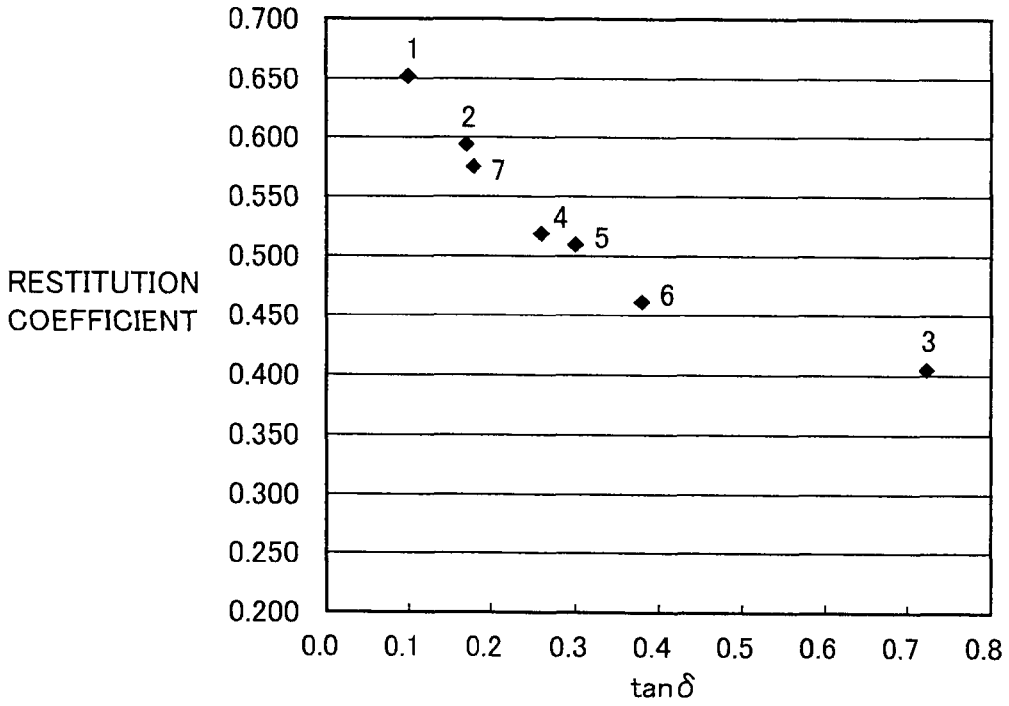
FIG. 13 shows a relationship between restitution coefficient and tan δ of the samples in the example.

Referring to FIG. 13, it was found that there was a correlation between the restitution coefficient and tan δ in samples 1 to 7. A vertical axis in FIG. 13 indicates the magnitude of restitution coefficient and a horizontal axis indicates the magnitude of tan δ. It was found that when tan δ was 0.3 or less, the restitution coefficient was 0.50 or more. It was found that when tan δ was 0.3 or less, the restitution coefficient higher than that of the ball for rubber-ball baseball was obtained because the restitution coefficient of the ball for rubber-ball baseball was 0.450 to 0.455 as shown in Table 1.

Figure 14:
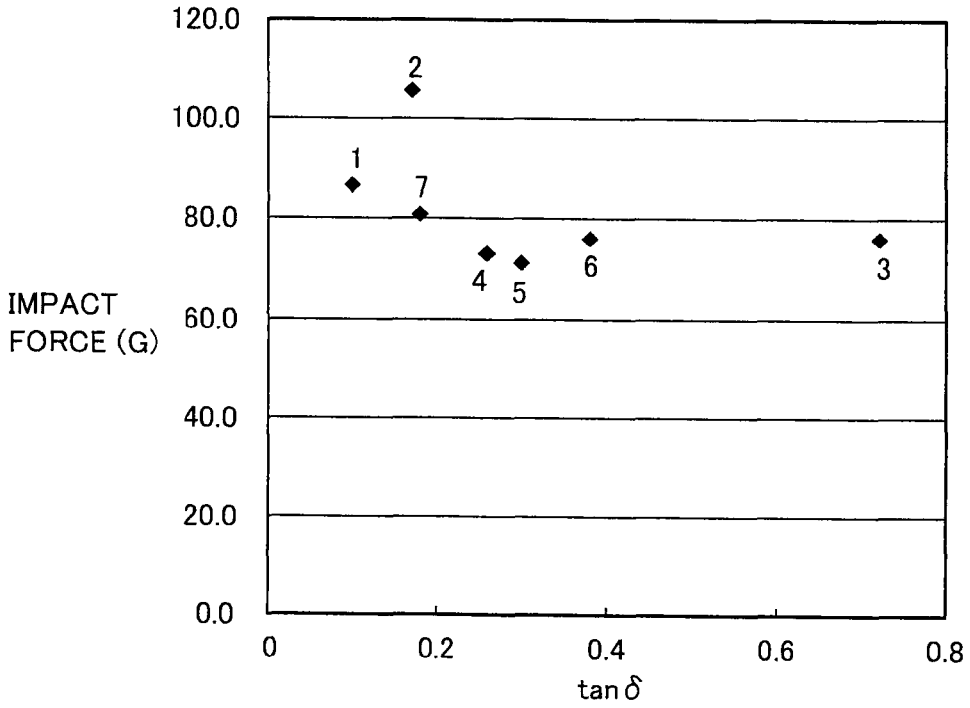
FIG. 14 shows a relationship between impact force and tan δ of the samples in the example.

Referring to FIG. 14, it was found that there was no correlation between the impact force (G) and tanδ in samples 1 to 7. A vertical axis in FIG. 14 indicates the magnitude of impact force (G) and a horizontal axis indicates the magnitude of tanδ.

As a result, it was found that there was a correlation between the impact force (G) and the elastic modulus (MPa), and that there was a correlation between the restitution coefficient and tanδ.

Figure 15:
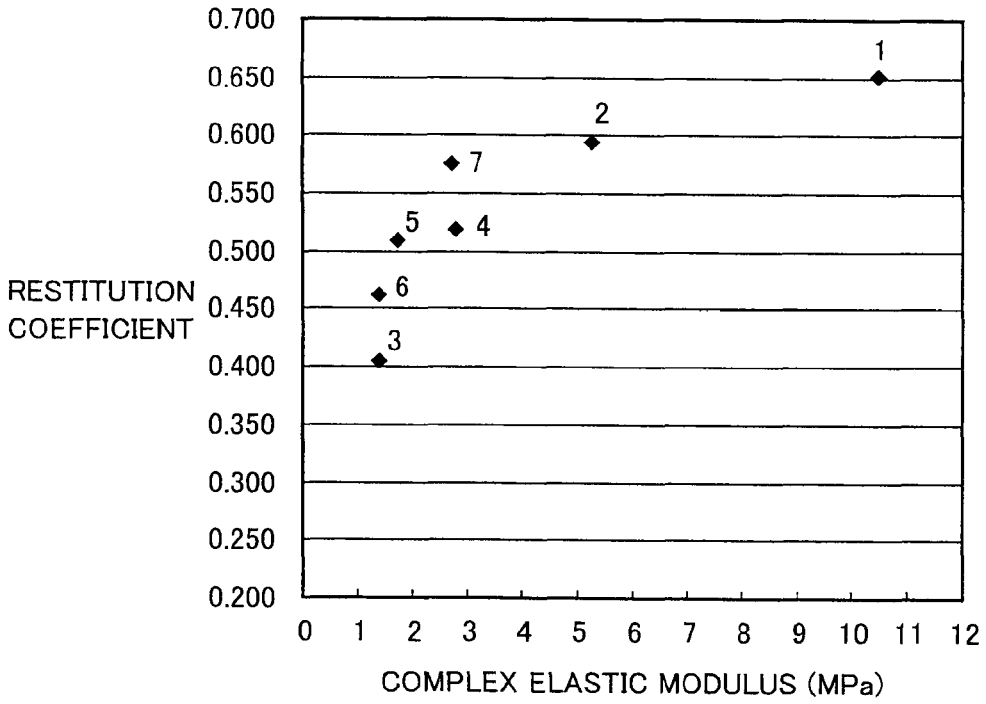
FIG. 15 shows a relationship between restitution coefficient and complex elastic modulus of the samples in the example.

Referring to FIG. 15, it was found that there was a correlation between the restitution coefficient and the complex elastic modulus (MPa) in samples 1 to 7. A vertical axis in FIG. 15 indicates the magnitude of restitution coefficient, and a horizontal axis indicates the magnitude of complex elastic modulus (MPa).

Figure 16:
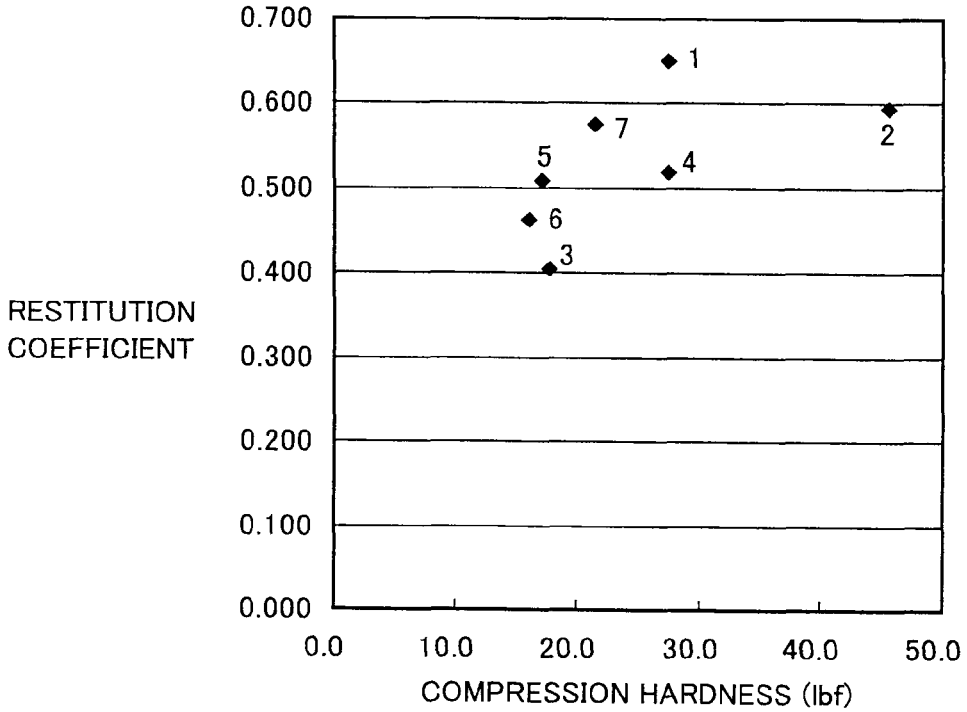
FIG. 16 shows a relationship between restitution coefficient and compression hardness of the samples in the example.

Referring to FIG. 16, it was found that there was no correlation between the restitution coefficient and the compression hardness (lbf) in samples 1 to 7. A vertical axis in FIG. 16 indicates the magnitude of restitution coefficient, and a horizontal axis indicates the magnitude of compression hardness (lbf).

Next, changes in the reaction force and the restitution coefficient were examined by changing the thicknesses of the inner core and the outer core of the baseball having the two-layer core.

Figure 17:
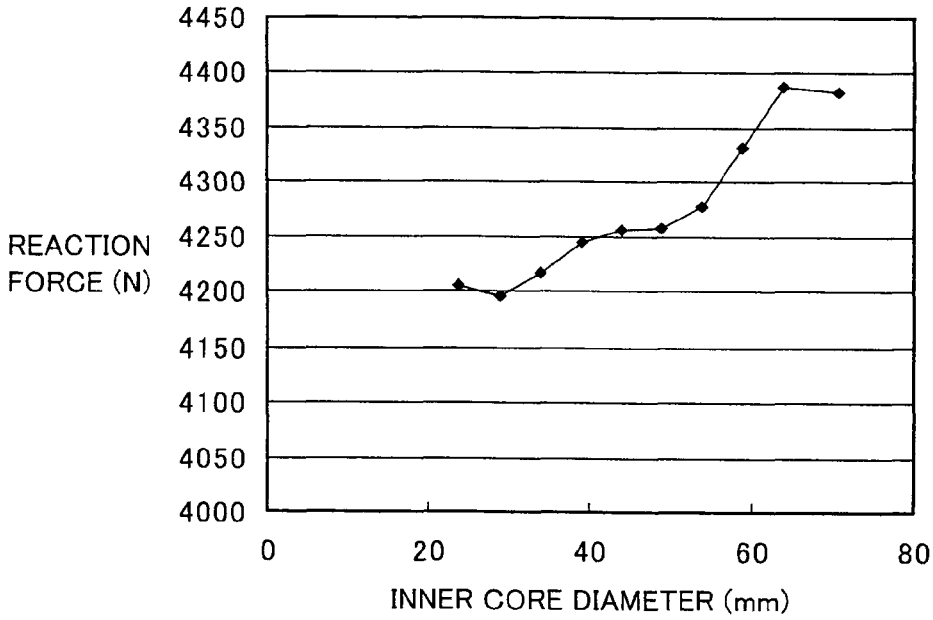
FIG. 17 shows a relationship between reaction force and inner core diameter in Example.
Figure 18:
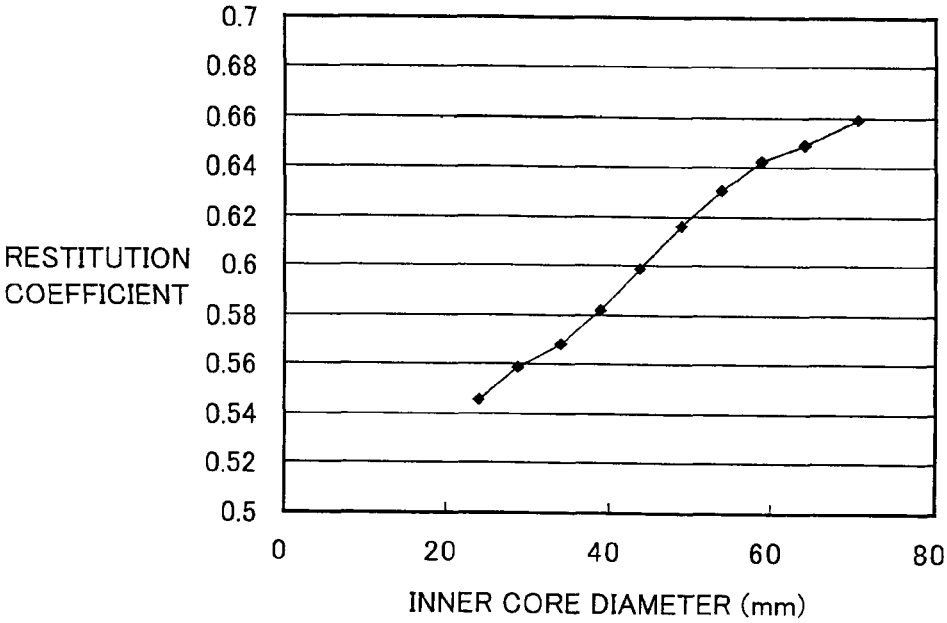
FIG. 18 shows a relationship between restitution coefficient and inner core diameter in Example.

First, referring to Table 5, FIGS. 17 and 18, changes in the reaction force and the restitution coefficient were examined by changing an inner core diameter in Example D shown in Table 1. A vertical axis in FIG. 17 indicates the magnitude of reaction force (N) and a horizontal axis indicates the magnitude of inner core diameter (mm). A vertical axis in FIG. 18 indicates the magnitude of restitution coefficient and a horizontal axis indicates the magnitude of inner core diameter (mm). When the inner core diameter was 24 mm, the reaction force was 4206 N, and when the inner core diameter was 54 mm, the reaction force was 4278 N. As a result, it was found that when the inner core diameter was 24 mm or more and 54 mm or less, the reaction force was 4300 N or less. It was also found that when the inner core diameter was 24 mm or more and 54 mm or less, the restitution coefficient was 0.546 or more and 0.631 or less.

TABLE 5

| | thickness | | | |
|---|---|---|---|---|
| inner core diameter (mm) | inner core (mm) | outer core (mm) | reaction force (N) | restitution coefficient |
| 24 | 12.0 | 23.35 | 4206 | 0.546 |
| 29 | 14.5 | 20.85 | 4195 | 0.559 |
| 34 | 17.0 | 18.35 | 4217 | 0.568 |
| 39 | 19.5 | 15.85 | 4244 | 0.582 |
| 44 | 22.0 | 13.35 | 4256 | 0.599 |
| 49 | 24.5 | 10.85 | 4258 | 0.616 |
| 54 | 27.0 | 8.35 | 4278 | 0.631 |
| 59 | 29.5 | 5.85 | 4332 | 0.642 |
| 64 | 32.0 | 3.35 | 4387 | 0.649 |
| 70.7 | 35.4 | 0 | 4383 | 0.659 |

Figure 19:
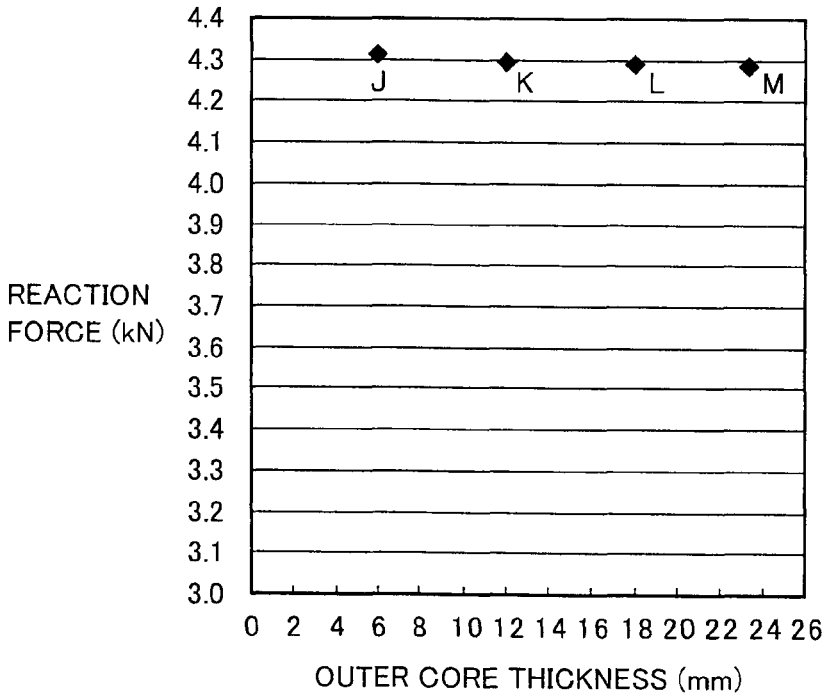
FIG. 19 shows a relationship between reaction force and outer core thickness in Examples.

Subsequently, referring to Table 6, FIGS. 19 and 20, changes in the reaction force and the restitution coefficient were examined by changing the thickness of the inner core and the thickness of the outer core in Example D shown in Table 1. A vertical axis in FIG. 19 indicates the magnitude of reaction force (kN) and a horizontal axis indicates the magnitude of outer core thickness (mm). A vertical axis in FIG. 20 indicates the magnitude of restitution coefficient and a horizontal axis indicates the magnitude of outer core thickness (mm). As shown in Table 6 and FIG. 19, when the outer core thickness was 12 mm, the reaction force was 4292 N, and when the outer core thickness was 23.35 mm, the reaction force was 4285 N. As a result, it was found that when the outer core thickness was 12 mm or more, the reaction force was 4292 N or less.

TABLE 6

| | inner core thickness (mm) | outer core thickness (mm) | restitution coefficient | reaction force (N) |
|---|---|---|---|---|
| Example J | 29.35 | 6 | 0.643 | 4.310 |
| Example K | 23.35 | 12 | 0.607 | 4.292 |
| Example L | 17.35 | 18 | 0.570 | 4.291 |
| Example M | 12 | 23.35 | 0.544 | 4.285 |

Figure 20:
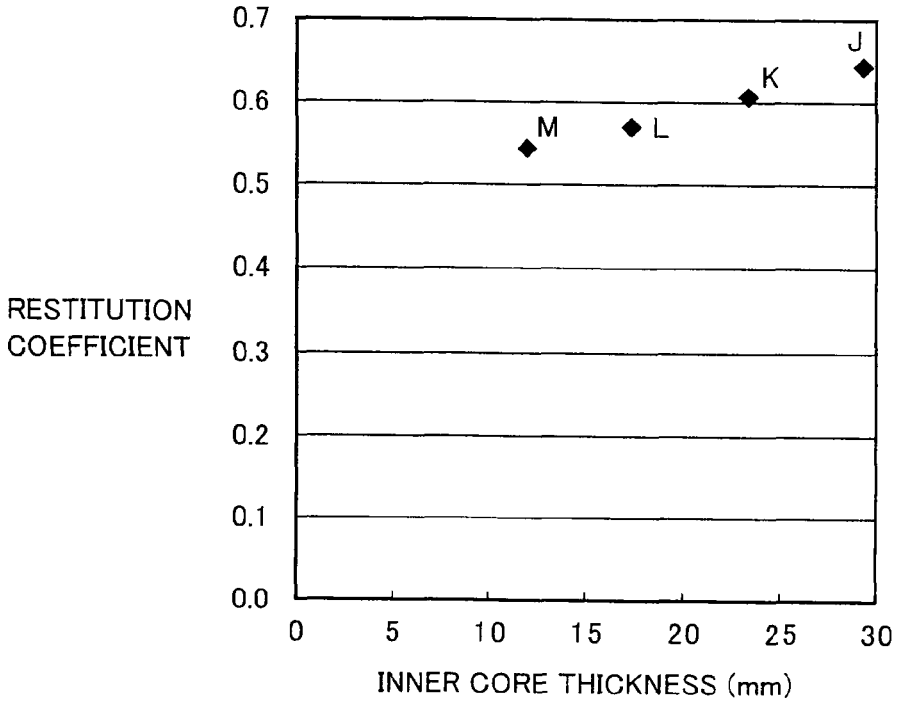
FIG. 20 shows a relationship between restitution coefficient and inner core thickness in Examples.

As shown in Table 6 and FIG. 20, when the inner core thickness was 12 mm, the reaction force was 4285 N and the restitution coefficient was 0.544. When the inner core thickness was 29.35 mm, the reaction force was 4310 N and the restitution coefficient was 0.643. As a result, it was found that as the inner core thickness increased, the restitution coefficient increased more as compared with the reaction force.

Next, changes in the reaction force and the restitution coefficient were examined by changing the material of the outer core of the baseball having the two-layer core.

Figure 21:
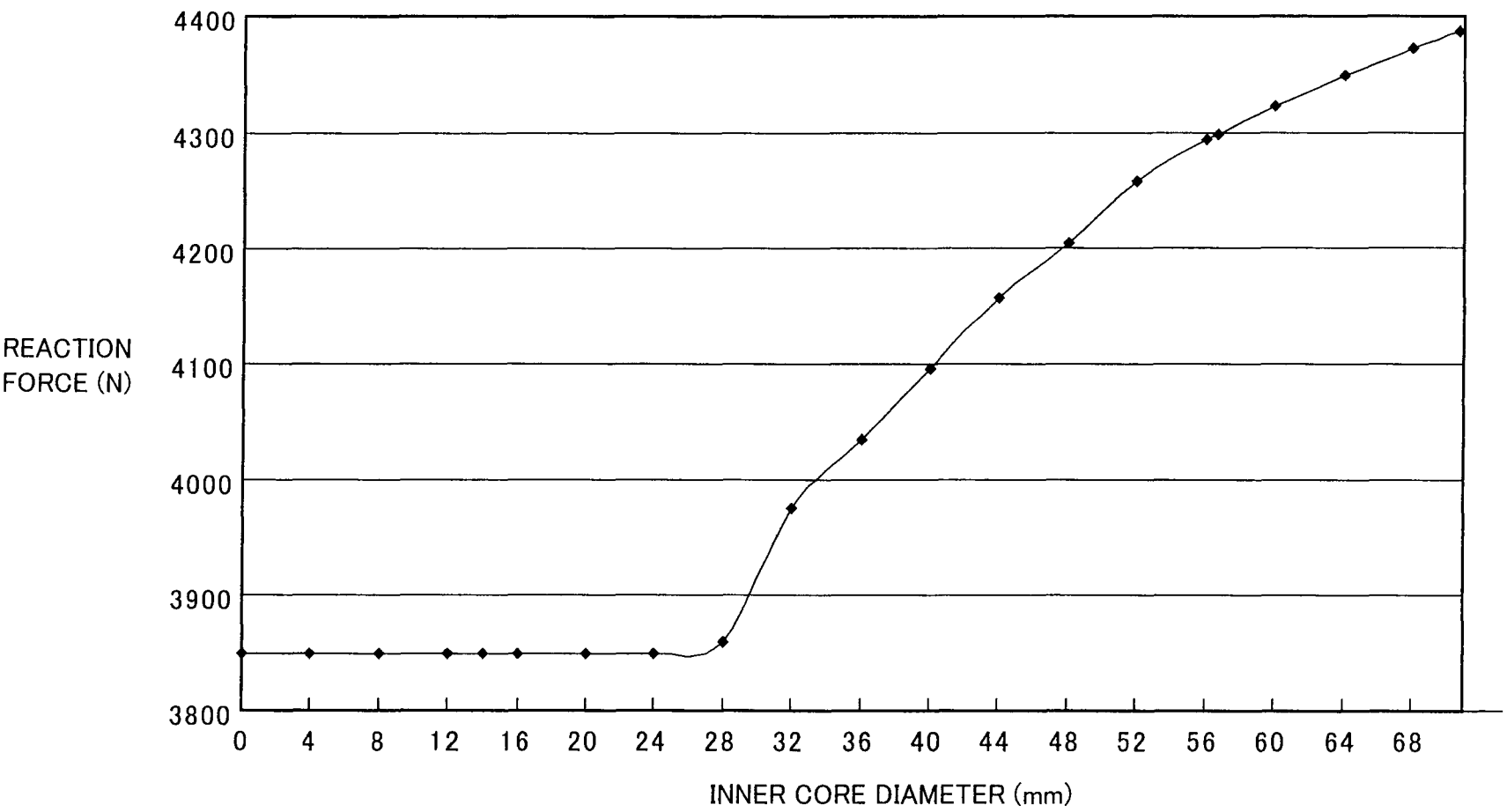
FIG. 21 shows a relationship between reaction force and inner core diameter in Example.
Figure 22:
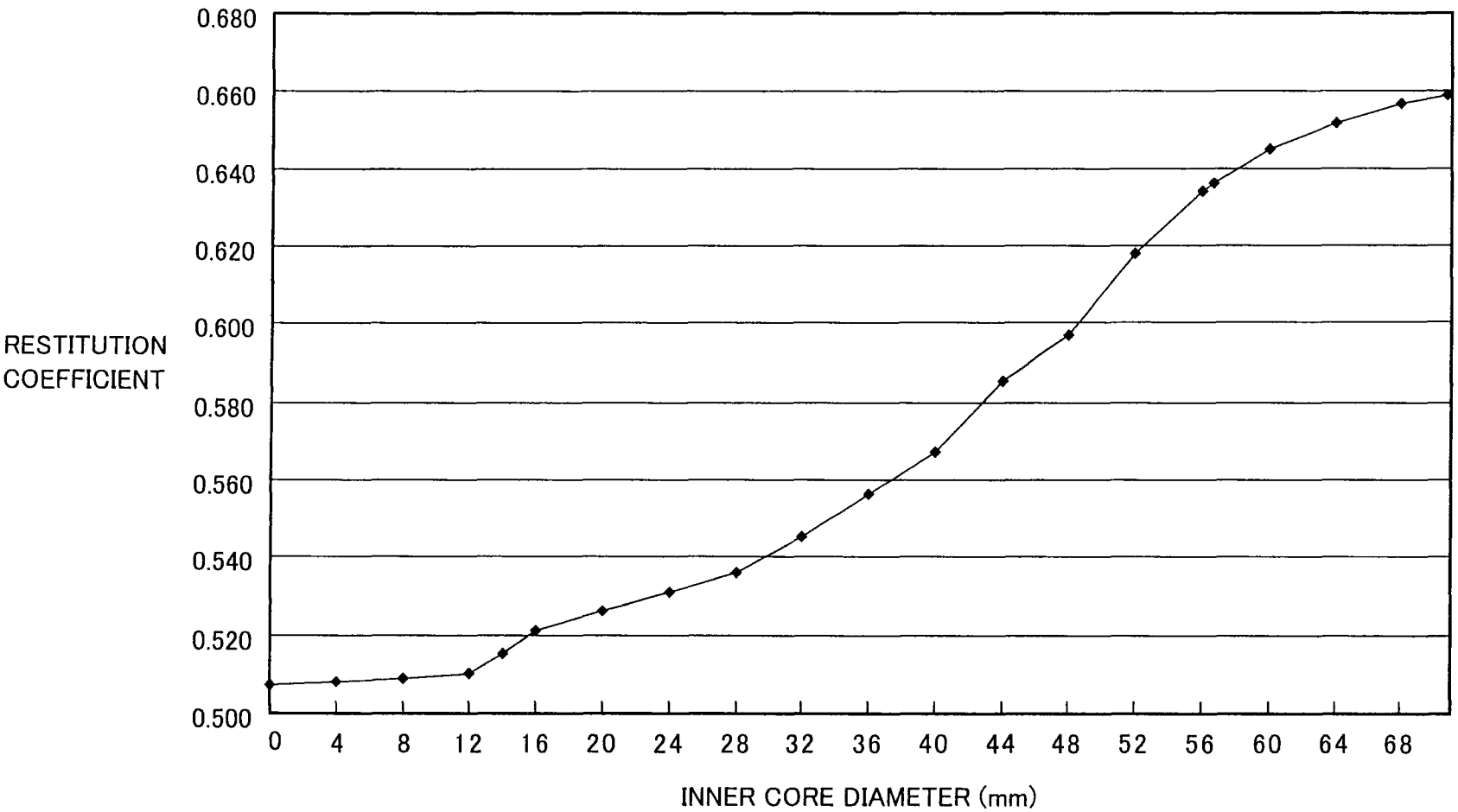
FIG. 22 shows a relationship between restitution coefficient and inner core diameter in Example.

Referring to Table 7, FIGS. 21 and 22, changes in the reaction force and the restitution coefficient were examined by changing the thicknesses of the inner core and the outer core of the baseball having the two-layer core. A vertical axis in FIG. 21 indicates the magnitude of reaction force (N) and a horizontal axis indicates the magnitude of inner core diameter (mm). A vertical axis in FIG. 22 indicates the magnitude of restitution coefficient and a horizontal axis indicates the magnitude of inner core diameter (mm). Sample 1 in Table 4 was used as the material of the inner core and sample 5 in Table 4 was used as the material of the outer core.

TABLE 7

| inner core | | outer core | | | |
|---|---|---|---|---|---|
| diameter (mm) | proportion (%) | thickness (mm) | proportion (%) | reaction force (N) | restitution coefficient |
| 0 | 0 | 35.4 | 100 | 3850 | 0.507 |
| 4 | 6 | 33.4 | 94 | 3850 | 0.508 |
| 8 | 11 | 31.4 | 89 | 3850 | 0.509 |
| 12 | 17 | 29.4 | 83 | 3850 | 0.510 |
| 14 | 20 | 28.4 | 80 | 3850 | 0.515 |
| 16 | 23 | 27.4 | 77 | 3850 | 0.521 |
| 20 | 28 | 25.4 | 72 | 3850 | 0.526 |
| 24 | 34 | 23.4 | 66 | 3850 | 0.531 |
| 28 | 40 | 21.4 | 60 | 3860 | 0.536 |
| 32 | 45 | 19.4 | 55 | 3976 | 0.545 |
| 36 | 51 | 17.4 | 49 | 4035 | 0.556 |
| 40 | 57 | 15.4 | 43 | 4096 | 0.567 |
| 44 | 62 | 13.4 | 38 | 4156 | 0.585 |
| 48 | 68 | 11.4 | 32 | 4205 | 0.597 |
| 52 | 74 | 9.4 | 26 | 4258 | 0.618 |
| 56 | 79 | 7.4 | 21 | 4294 | 0.634 |
| 56.7 | 80 | 7.0 | 20 | 4298 | 0.636 |
| 60 | 85 | 5.4 | 15 | 4323 | 0.645 |
| 64 | 91 | 3.4 | 9 | 4350 | 0.652 |
| 68 | 96 | 1.4 | 4 | 4373 | 0.657 |
| 70.7 | 100 | 0.0 | 0 | 4387 | 0.659 |

Referring to Table 7 and FIG. 21, when the outer core thickness was 7.0 mm (proportion: 20%), the reaction force was 4298 N. As a result, it was found that when the proportion of the outer core thickness was 20% or more, the reaction force was 4298 N or less. Referring to Table 7 and FIG. 22, it was found that when the inner core diameter was 14 mm (proportion: 20%), the restitution coefficient was 0.515, and an inclination of the graph became larger and the restitution coefficient became higher as compared with the case where the inner core diameter was 0 to 12 mm.

It should be noted that the above-mentioned baseball includes a softball and the present invention is also applicable to the softball. A core of the softball has an outer diameter of, for example, 93.9 mm. The softball configured by affixing leather to the core of the softball and sewing up the leather with a sewing thread has an outer circumference of for example, 305 mm and an outer diameter of, for example, 97.1 mm.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A baseball, comprising:

an inner core; and an outer core covering an outer circumferential surface of said inner core, wherein said inner core has an outer dimension of between 20% and 80% of a diameter of the combined core of said baseball formed by said inner core and said outer core, wherein said inner core has a dynamic viscoelasticity loss coefficient (tan.delta.) of 0.3 or less, wherein said outer core has a thickness of 10% and 40% of said diameter of said combined core, and wherein said outer core has an elastic modulus of 1.5 MPa or less.

2. The baseball according to claim 1, wherein a reaction force when said baseball is hit at a speed of 26.82 m/s is 4300 N or less.

3. The baseball according to claim 1, wherein a restitution coefficient when said baseball hits against an iron plate at a speed of 26.82 m/s is 0.50 or more.

4. The baseball according to claim 3, wherein said restitution coefficient is 0.55 or less, and a load required to compress said baseball 6.35 mm is less than 45 lbf.

5. A baseball, comprising:

an inner core; and an outer core covering an outer circumferential surface of said inner core, a thread-wound layer configured by winding a thread to cover an outer circumferential surface of said outer core; and an outer layer covering an outer circumferential surface of said thread-wound layer, wherein said inner core has an elastic modulus of between 1.0 MPa and 1.3 MPa, a dynamic viscoelasticity loss coefficient (tan.delta.) of between 0.10 and 0.20 , and an outer diameter of 34 mm, wherein said outer core having an elastic modulus of between 0.6 MPa and 1.0 MPa and a dynamic viscoelasticity loss coefficient (tan .delta.) of between 0.26 or and 0.30, and wherein the diameter of the combined core of said baseball, formed by said inner core and said outer core of said baseball is 70.7 mm.

6. A baseball, comprising:

an inner core; and an outer core covering an outer circumferential surface of said inner core, wherein said inner core has an outer diameter of between 20% and 80% of the diameter of the combined core of said baseball formed by said inner core and said outer core, wherein said inner core has a dynamic viscoelasticity loss coefficient (tan.delta.) lower than that of said outer core, and wherein said outer core has a thickness of 10% and 40% of said diameter of said combined core of said baseball, and said outer core has an elastic modulus lower than that of said inner core.

7. The baseball according to claim 6, wherein the dynamic viscoelasticity loss coefficient (tan.delta.) of said inner core is 0.3 or less.

* * * * *